US010436429B2

(12) United States Patent
Concepcion

(10) Patent No.: US 10,436,429 B2
(45) Date of Patent: Oct. 8, 2019

(54) COMPRESSION ACTIVATED SWITCH DEVICE FOR LED CIRCUIT BOARDS

(71) Applicant: Inform Lightworks, Inc., Beacon, NY (US)

(72) Inventor: Jonas Concepcion, Beacon, NY (US)

(73) Assignee: Inform Lightworks, Inc., Beacon, NY (US)

( * ) Notice: Subject to any disclaimer, the term of this patent is extended or adjusted under 35 U.S.C. 154(b) by 0 days.

(21) Appl. No.: 16/263,662

(22) Filed: Jan. 31, 2019

(65) Prior Publication Data

US 2019/0162399 A1 May 30, 2019

Related U.S. Application Data

(63) Continuation of application No. 15/003,391, filed on Jan. 21, 2016, now Pat. No. 10,234,120.

(51) Int. Cl.

| | |
|---|---|
| ***H01H 13/14*** | (2006.01) |
| ***F21V 23/04*** | (2006.01) |
| ***F21V 29/74*** | (2015.01) |
| ***H01H 21/02*** | (2006.01) |

(Continued)

(52) U.S. Cl.

CPC ..... *F21V 23/04* (2013.01); *F21V 29/74* (2015.01); *H01H 21/00* (2013.01); *H01H 21/025* (2013.01); *F21Y 2115/10* (2016.08)

(58) Field of Classification Search

CPC ..... H01H 3/125; H01H 13/70; H01H 13/705; H01H 13/83; H01H 2219/062; H01H 2219/036; H01H 13/023; H01H 3/06; H01H 13/86; H01H 2223/002; H01H 2223/008; F21Y 2115/10; F21Y 2113/13;

(Continued)

(56) References Cited

U.S. PATENT DOCUMENTS

| | | | | |
|---|---|---|---|---|
| 4,135,231 A | | 1/1979 | Fisher | |
| 4,302,647 A | * | 11/1981 | Kandler | H01H 13/83 200/16 A |
| 5,817,997 A | | 10/1998 | Wernig | |

(Continued)

OTHER PUBLICATIONS

Non-Final Office Action dated Jul. 25, 2017 for U.S. Appl. No. 15/003,391, filed Jan. 21, 2016; pp. 15.

(Continued)

*Primary Examiner* — Ahmed M Saeed

(74) *Attorney, Agent, or Firm* — Hoffman Warnick LLC

(57) ABSTRACT

Various embodiments of a compression activated switch device for holding light emitting packages are provided. The device includes an electrical switch configured to operatively couple between a light emitting package and a power source. The light emitting package includes a light emitting element on a support, the electrical switch biased to an open position from a closed position. The compression activated switch also includes a coupling component configured to couple the light emitting package to a structure and a biasing element biasing against coupling the light emitting package to the structure with a predetermined force, wherein in response to a force being applied to the coupling component sufficient to overcome the predetermined force the electric switch moves to the closed position. Visual or audible feedback may be provided upon the application of the predetermined amount of force.

20 Claims, 6 Drawing Sheets

(51) Int. Cl.
*H01H 21/00* (2006.01)
*F21Y 115/10* (2016.01)

(58) Field of Classification Search
CPC ..... F21Y 2103/10; F21Y 2105/10; F21Y 2101/00; F21Y 2113/17
USPC ..... 200/5 A, 310–314, 344, 249, 286, 251, 200/261, 303, 304, 318.1; 362/367, 368, 362/372–374
See application file for complete search history.

(56) References Cited

U.S. PATENT DOCUMENTS 7,976,335 B2 7/2011 Weber et al.
8,162,506 B2 * 4/2012 Wei ..... F21V 9/40 362/231
8,641,234 B2 2/2014 Dube et al.
8,764,238 B2 7/2014 Brukilacchio
8,764,248 B1 7/2014 Simon
8,845,146 B2 9/2014 Blankestijn et al.
9,441,817 B2 * 9/2016 Chiu ..... F21V 19/0055
2009/0152081 A1 6/2009 Sharrah et al.
2010/0284198 A1 11/2010 Willwohl et al.
2012/0048702 A1 * 3/2012 Liu ..... H01H 3/125 200/5 A
2013/0301671 A1 11/2013 Megarity et al.
2014/0175978 A1 6/2014 Kobayashi
2014/0177226 A1 6/2014 Goelz et al.
2016/0076754 A1 * 3/2016 Creusen ..... F21V 29/505 362/84

OTHER PUBLICATIONS

Final Office Action dated Jul. 25, 2018 for U.S. Appl. No. 15/003,391, filed Jan. 21, 2016; pp. 9.
Notice of Allowance and Fee(s) Due dated Nov. 2, 2018 for U.S. Appl. No. 15/003,391, filed Jan. 21, 2016; pp. 7.

* cited by examiner

COMPRESSION ACTIVATED SWITCH DEVICE FOR LED CIRCUIT BOARDS

BACKGROUND

The subject matter disclosed herein relates to a compression activated switch device for light emitting circuit boards, including light emitting diode (LED) circuit boards, activated by compression. More particularly, the subject matter relates to a compression activated switch device which provides electrical continuity under a predetermined amount of force applied during installation. Visual or audible feedback may be provided upon the application of the predetermined amount of force.

As solid state lighting systems have increased in usage, they have begun being produced in a greater variety of types of packages designed to suit multiple applications. Many of these systems include similar components, typically a light module (a circuit board containing at least one LED), a power supply or LED driver, a housing combined with or designed to connect to a heatsink, and some wiring and hardware. Many applications utilize a high power density. For instance, some LEDs operate at tens of milliamps (mA), while high power density LEDs may be driven at hundreds of mA or even over an ampere, requiring the use of a heatsink. Good thermal connection between the heatsink and the light module is important for operation of the light fixture within its design specification by allowing for sufficient heat dissipation.

Poor thermal connection between the light module and heatsink can result in multiple problems with solid state lighting devices. Some issues can include a reduction in performance, including a reduced lifetime of the light module, reduced efficiency of the system, and color shifting. Other issues can include a reduction in safety, such as exceeding the rated temperature of surrounding components and greater risk of failure.

In an effort to increase thermal connectivity between LED modules and heatsinks, the connections are often augmented with a thermal interface material (TIM) between the components. The performance of the TIM is highly dependent on a minimum thickness achieved by compression. Typically, a threaded fastener is employed to secure the LED module and the heatsink as well as to compress the TIM. Oftentimes a holder is employed to distribute the force of the threaded fastener onto the LED module. In using these components, a TIM manufacturer will often specify a minimum amount of compression in order to facilitate a good thermal connection. Further, a holder manufacturer will specify a fastener type and torque setting in order to achieve proper compression of the TIM or module. However, even following recommended practices during assembly, there is no practical method for verifying a sufficient thermal connection has been made.

For instance, a direct measurement of the pressure applied on a TIM is often difficult due to the inability to access the connection with an instrument. Indirect measurements such as temperature reading of the light module can take hours for the system to reach thermal equilibrium and the values can be heavily skewed by other factors. Thus, in most cases, compression is verified indirectly by confirming the fastener size and torque application. There are drawbacks to this method. Firstly, a torque screwdriver or other instrument is required and may be out of calibration. Secondly, the application of a specific torque on a fastener can produce a highly variable amount of compression. Contaminants or defects on the fastener thread, for instance, can increase the torque required to achieve suitable compression. A cross threaded condition can occur and bind the fasteners, which may result in a proper torque condition but with no compression on the TIM at all. Thirdly, the environmental conditions of installation may be less than ideal. The prior issues may be overcome within a factory assembly setting. However, in field service scenarios where the thermal connection between light module and heatsink is broken and then recreated during the installation of a replacement lamp unit, many of the aforementioned difficulties are amplified. In addition, installation can be affected by the skill of the contractor, location of the lighting system, the presence of contaminants, and whether the contractor has a particular and accurate torque wrench.

SUMMARY

Various embodiments include compression activated switch devices.

A first aspect includes a compression activated switch device, comprising: an electrical switch configured to operatively couple between a light emitting package and a power source, wherein the light emitting package includes a light emitting element on a support, the electrical switch biased to an open position from a closed position; a coupling component configured to couple the light emitting package to a structure; and a biasing element biasing against coupling the light emitting package to the structure with a predetermined force, wherein in response to a force being applied to the coupling component sufficient to overcome the predetermined force the electric switch moves to the closed position.

A second aspect includes a compression activated switch device, comprising: a first electrical switch configured to operatively couple between a first contact of a light emitting package and a power source, wherein the light emitting package includes a light emitting element positioned on a support, the first electrical switch biased to an open position from a closed position; a coupling component configured to couple the LED package to a structure; a first biasing element biasing against coupling the light emitting package to the structure with a first predetermined force, wherein in response to a force being applied to the first coupling component sufficient to overcome the first predetermined force, the first electric switch moves to the closed position of the first electrical switch; a second electrical switch operatively couple between a second contact of the light emitting package and a power source, the second electrical switch biased to an open position from a closed position; and a second biasing element biasing against coupling the light emitting package to the structure with a second predetermined force, wherein in response to a force being applied to the second coupling component sufficient to overcome the second predetermined force, the second electric switch moves to the closed position of the second electrical switch.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which:

FIG. 3A-3C shows various, perspective views of a compression activated switch device according to various embodiments. Specifically, FIG. 3A shows a perspective view of a compression activated switch device, FIG. 3B shows an enlarged, perspective view of a switch element of the compression activated switch device of FIG. 3A in a closed position according to various embodiments, and FIG. 3C shows an enlarged, perspective view of a switch element of the compression activated switch device of FIG. 3A in an open position according to various embodiments.

FIG. 4A shows a perspective view of a compression activated switch device, FIG. 4B shows an enlarged, perspective view of the compression activated switch device of FIG. 4A in a closed position, and FIG. 4C shows an enlarged, perspective view of the compression activated switch device of FIG. 4A in an open position according to various embodiments.

Figure 1B:
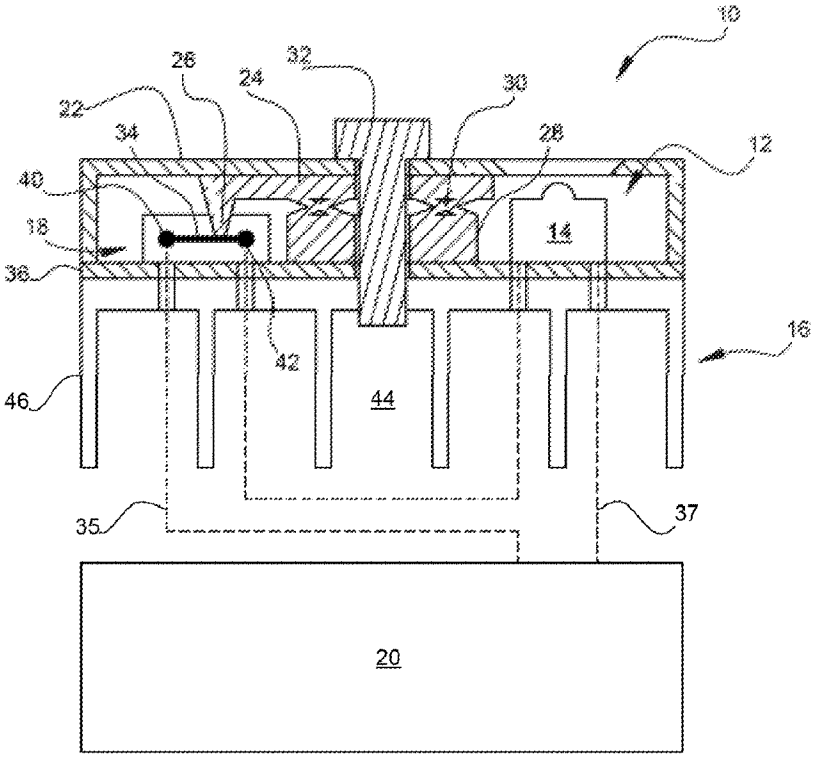
FIG. 1B shows a side partial cross-sectional view of a compression activated switch device in a closed position in line with an LED according to various embodiments.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

As noted, the subject matter disclosed herein relates to compression activated switch devices.

According to various embodiments of the present disclosure, compression activated switch devices are provided which include a pressure sensitive biasing element that causes an electrical switch to remain open until a predetermined amount of force is applied between a coupling component and a structure, ensuring sufficient compression for a proper thermal connection between a light emitting package and a structure.

In the following description, reference is made to the accompanying drawings that form a part thereof, and in which is shown, by way of illustration, specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Figure 1A:
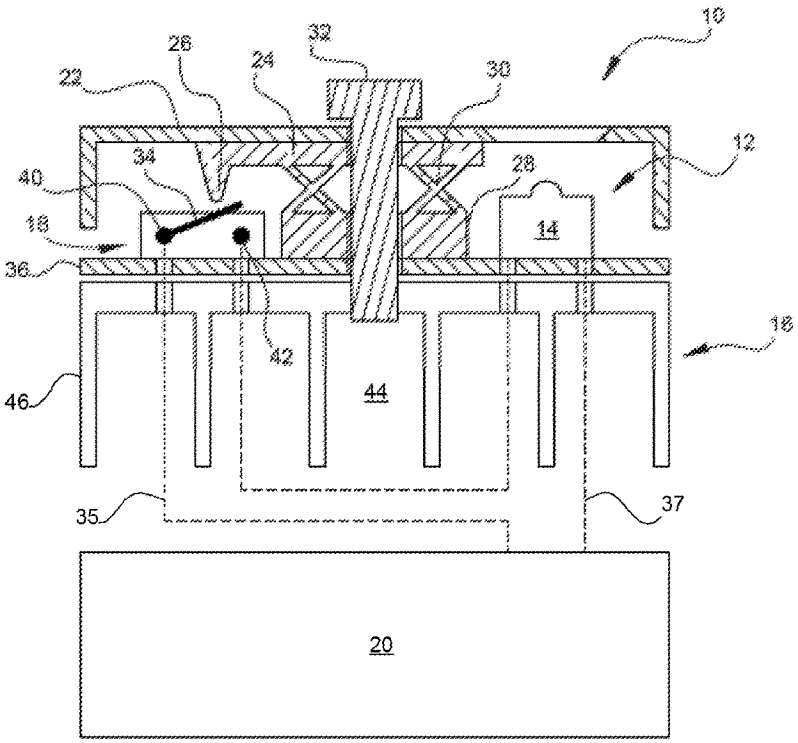
FIG. 1A shows a side partial cross-sectional view of a compression activated switch device in an open position in line with an LED according to various embodiments.

Turning to FIG. 1A, and similarly FIGS. 1B, 2A, and 2B, which will be explained in more detail below, a side partial cross-sectional view of a compression activated switch 10 is shown. In some embodiments, compression activated switch 10 includes an electrical switch 18 configured to operatively couple between a light emitting package 12 and a power source 20. Light emitting package 12 may include at least one light emitting element 14 on a support 16. Light emitting package 12, for instance, may include any light emitting package, including any and all light emitting diode (LED) packages, now known or later developed. Light emitting element 14 includes any element included in light emitting package 12 capable of emitting light, of any wavelength or combination of wavelengths when multiple light emitting elements 14 are used, and may include any source of light, including but not limited to LEDs. Power source 20 may include any source of power, including A/C and D/C power sources, capable of providing enough power to illuminate light emitting element 14 of light emitting package 12.

Support 16 may include a circuit board 36, for instance an LED circuit board, operatively positioned between structure 44 and biasing element 24. Circuit board 36 can include any circuitry necessary to operate light emitting package 12 and any associated light emitting element(s) 14 included thereon. Structure 44 may include any structure to which light emitting package 12 is to be coupled such as but not limited to a heatsink 46 positioned below circuit board 36. Heatsink 46 can include any now known or later developed structures designed for removing heat generated by light emitting package 12 from the device itself in order to reduce damage done to light emitting package 12. For example, heatsink 46 could include a thermally conductive body (e.g., aluminum) with a number of fingers extending therefrom. Compression activated switch device 10 provides a sufficient thermal connection between circuit board 36 and heatsink 46 to ensure sufficient thermal transfer.

Figure 2B:
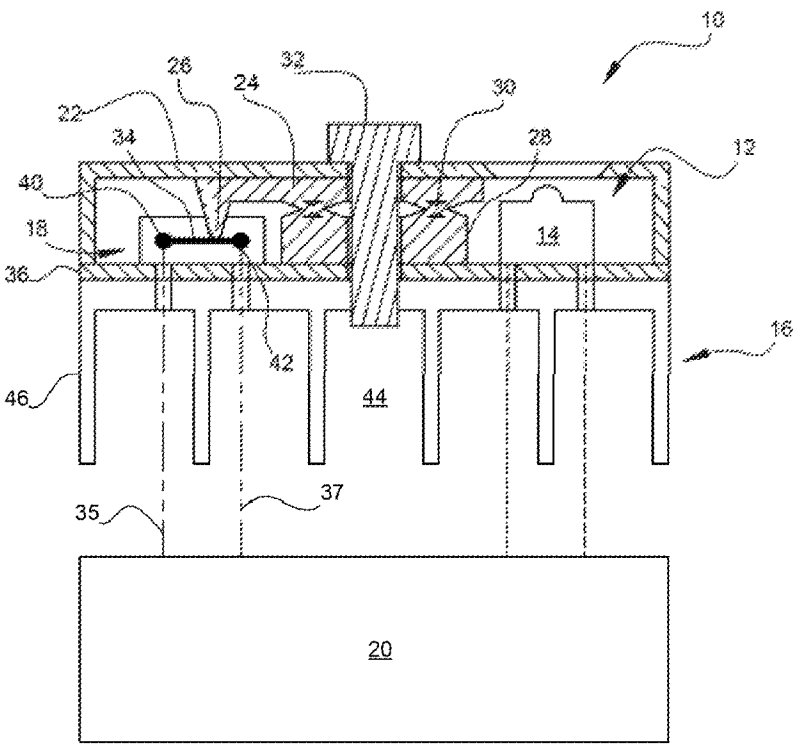
FIG. 2B shows a side partial cross-sectional view of a compression activated switch device in a closed position according to various embodiments.
Figure 2A:
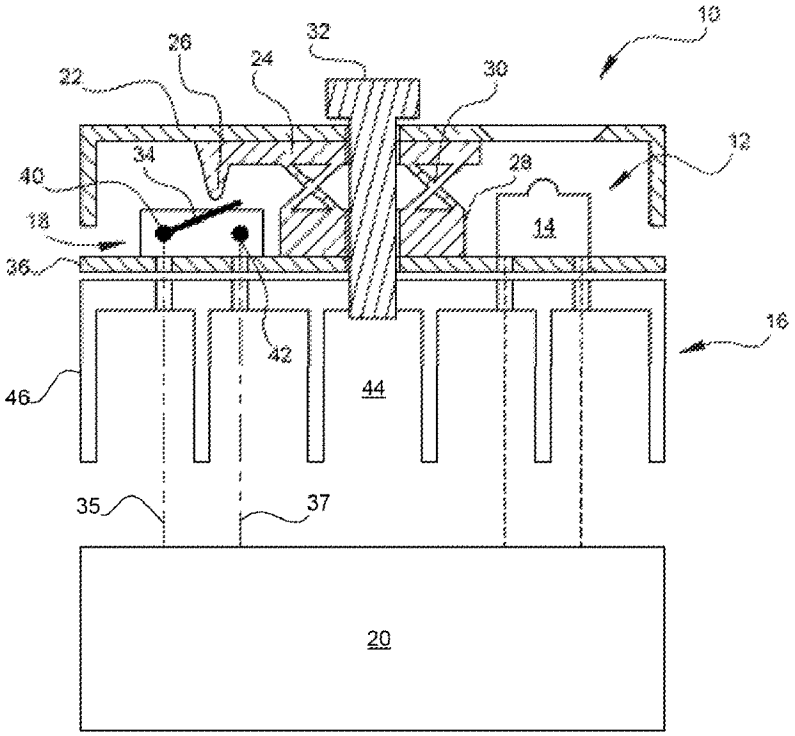
FIG. 2A shows a side partial cross-sectional view of a compression activated switch device in an open position according to various embodiments.

As illustrated in FIGS. 1A, 1B, 2A, and 2B, power source 20 may be wired to electrical switch 18 and light emitting package 12 by two lines 35, 37. In some embodiments, as illustrated in FIGS. 1A and 1B, power source 20 may be wired in line, with one line 35 to electrical switch 18 and continued to light emitting package 12 and one line 37 directly to light emitting package 12. In alternative embodiments, as illustrated in FIGS. 2A and 2B, both of wiring lines 35, 37 may be wired directly into electrical switch 18 such that two lines are directly wired, similarly, to light emitting package 12. Power source 20 may be wired in any way to electrical switch 18 and light emitting package 12, so long as power is only supplied to light emitting package 12 when electrical switch 18 is in the closed position. FIGS. 1A, 1B, 2A, and 2B are only examples of such wiring.

Figure 3A:
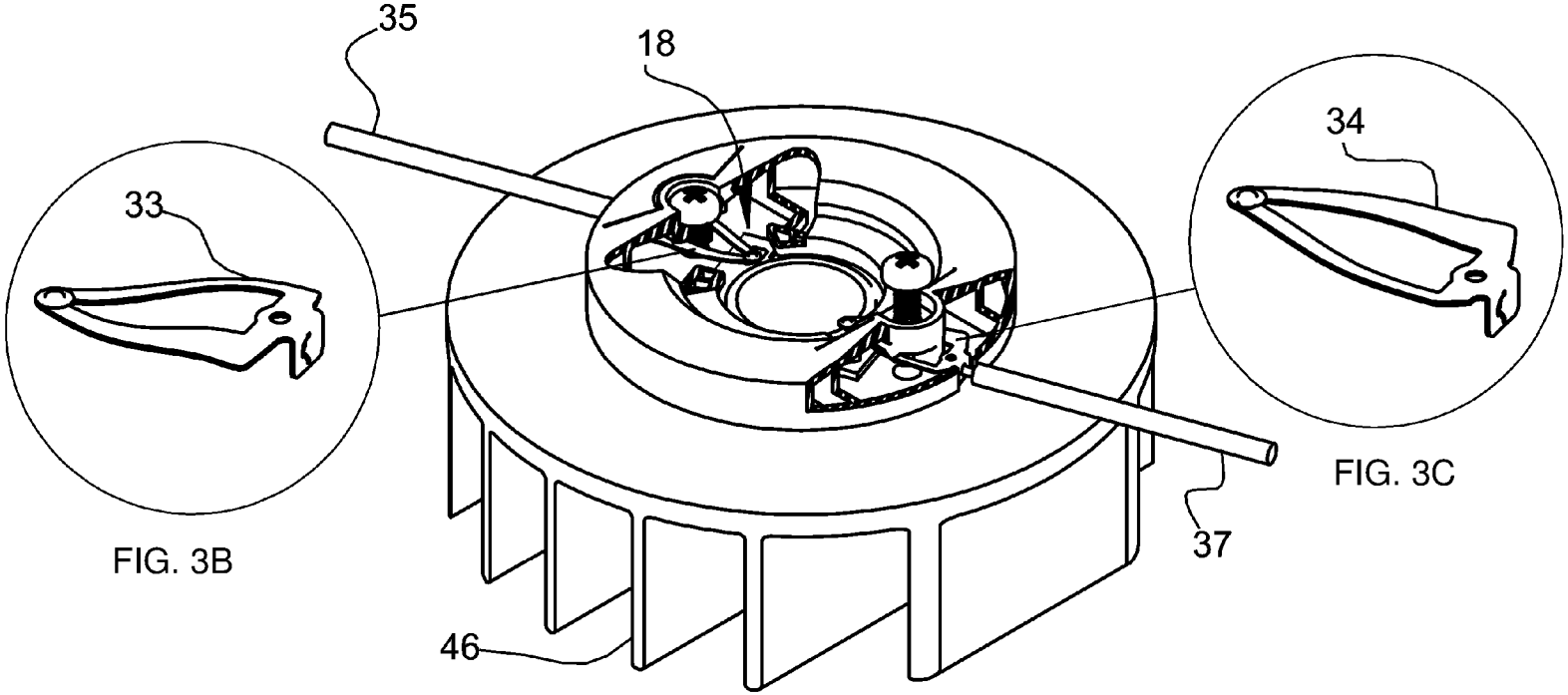

Referring back to FIG. 1A, electrical switch 18 may be biased to an open position from a closed position, i.e., electrically open position and electrically closed, conductive position. Electrical switch 18 can include any electrical switch that remains in an electrically open position from an electrically closed position until a predetermined amount of force is applied to the switch. For instance, a micro switch may be used, where micro switches can be small enough to fit in a compression activated switch device 10. For instance, as shown in FIGS. 3A-3C, electrical switch 18 may include a switch element 34 which is spring biased by a bend or kink in the metal thereof into an open position. FIG. 3C shows an example of an exploded view with switch element 34 in an open position, and FIG. 3B shows an example of an exploded view of switch element 33 in a closed position. When a predetermined amount of force is applied, the switch element 34 moves to a closed position switch element 33 as shown in FIG. 3B, closing the circuit between power source 20 and light emitting package 12 (FIGS. 1B and 2B).

Referring again to FIG. 1A, compression activated switch device 10 may also include a coupling component 22 configured to couple light emitting package 12 to structure 44. Coupling component 22 can include any metal, plastic, or composite article for mounting light emitting package 12 to structure 44, for instance, heatsink 46. Structure 44 may be mounted onto a ceiling or wall light fixture or any other area where a light emitting package 12 may be installed.

In some embodiments, compression activated switch 10 may include a fastener 32 (FIG. 1A) for applying the force to coupling component 22. As should be clear, force applied to fastener 32, for instance torque applied to a threaded fastener, applies force to coupling component 22 to act against a biasing element 24. As shown in FIG. 1B, in response to the force exceeding the predetermined amount of force provided by biasing element 24, a switch press element 26 forces switch element 34 of electrical switch 18 into an electrically closed position (FIG. 3B, 33).

Biasing element 24, for biasing against coupling light emitting package 12 to structure 44, biases with a predetermined force against coupling component 22 coupling light emitting package 22 to structure 44. Still referring to FIGS. 1A-B, biasing element 24 may include switch press element 26 operatively positioned to engage electrical switch 18. Applying pressure on biasing element 24 to close electrical switch 18 can be accomplished by applying a force to coupling component 22, for instance by fastener 32. Biasing element 24 can also include a base element 28 for applying pressure to light emitting package 12 to ensure that a good thermal connection is made. Biasing element 24 may also include a compressible component 30 operatively positioned between switch press element 26 and base element 28, wherein compressible component 30 defines the predetermined amount of force necessary to close electrical switch 18.

The predetermined force may be user selected. For example, the hardness, size, shape and materials of compressible component 30 used as part of biasing element 24 may be user selected to provide a required predetermined force. Compressible component 30 of biasing element 24 could also include a spring or a washer providing the desired, predetermined force requirement. In embodiments including a spring, the length of a spring and thickness of the coils may be selected to provide a desired, predetermined force requirement. In embodiments using a washer, different types of spring washers may be utilized. For instance, a bent washer or cupped washer may be used, including Belleville washers. Also, the size of the washer, the number of washers, or both may be varied in order to select the predetermined force. Additionally, compressible component 30 may include any structure geometrically configured to bias against compression until a predetermined amount of force is applied, and may be made from plastic, metal, or composite. The amount of predetermined force required may also be adjustable. Any means of adjustment are possible, such as but not limited to an adjustable spring element, e.g., with a set screw adjustment that changes the compression of the spring. In some embodiments, the predetermined amount of force may include between approximately 5 pounds and approximately 50 pounds. As used herein the term "approximately" indicates plus or minus 10% of the value(s) stated. Additionally, while electrical switch 18 may close at a predetermined amount of force, the predetermined amount of force is a tipping point or over center action. As such, although 10 pounds may be required to close electrical switch 18, it should not open unless the force applied is reduced by approximately 30% to approximately 40%.

Still referring to FIGS. 1A-B, electrical switch 18 may include a first electrode 40 and a second electrode 42, both electrically coupled to power source 20. First electrode 40 and second electrode 42 may be positioned in any position so long as electrical switch 18 and power source 20 are electrically coupled to light emitting package 12 and power is not supplied to light emitting package 12 when electrical switch 18 is open. Electrical switch 18 may include switch element 34 (FIGS. 3, 4 also) coupled to at least one of the electrodes and biased to the electrically open position. Switch element 34 may be any mechanism that biases open and closes upon application of pressure, such as a piece of metal that can "snap" shut. In any event, switch element 34 closes in response to pressure applied to fastener 32 and carried through to switch press element 26 applying sufficient pressure to switch element 34 to close.

In some embodiments, biasing element 24 and electrical switch 18 are integrated into coupling component 22. In these embodiments, for instance when coupling component 22 is a light module holder, fastener 32 may be included separately but the amount of force necessary may be determined by the manufacturer, as all of the components may be sealed inside of an enclosure, coupling component 22, for fastening to light emitting package 12. In further embodiments, fastener 32 may even be sealed within coupling component 22 such that force may be applied to fastener 32, but fastener 32 is not removable from casing of coupling component 22.

Figures 4A, 4B, 4C:
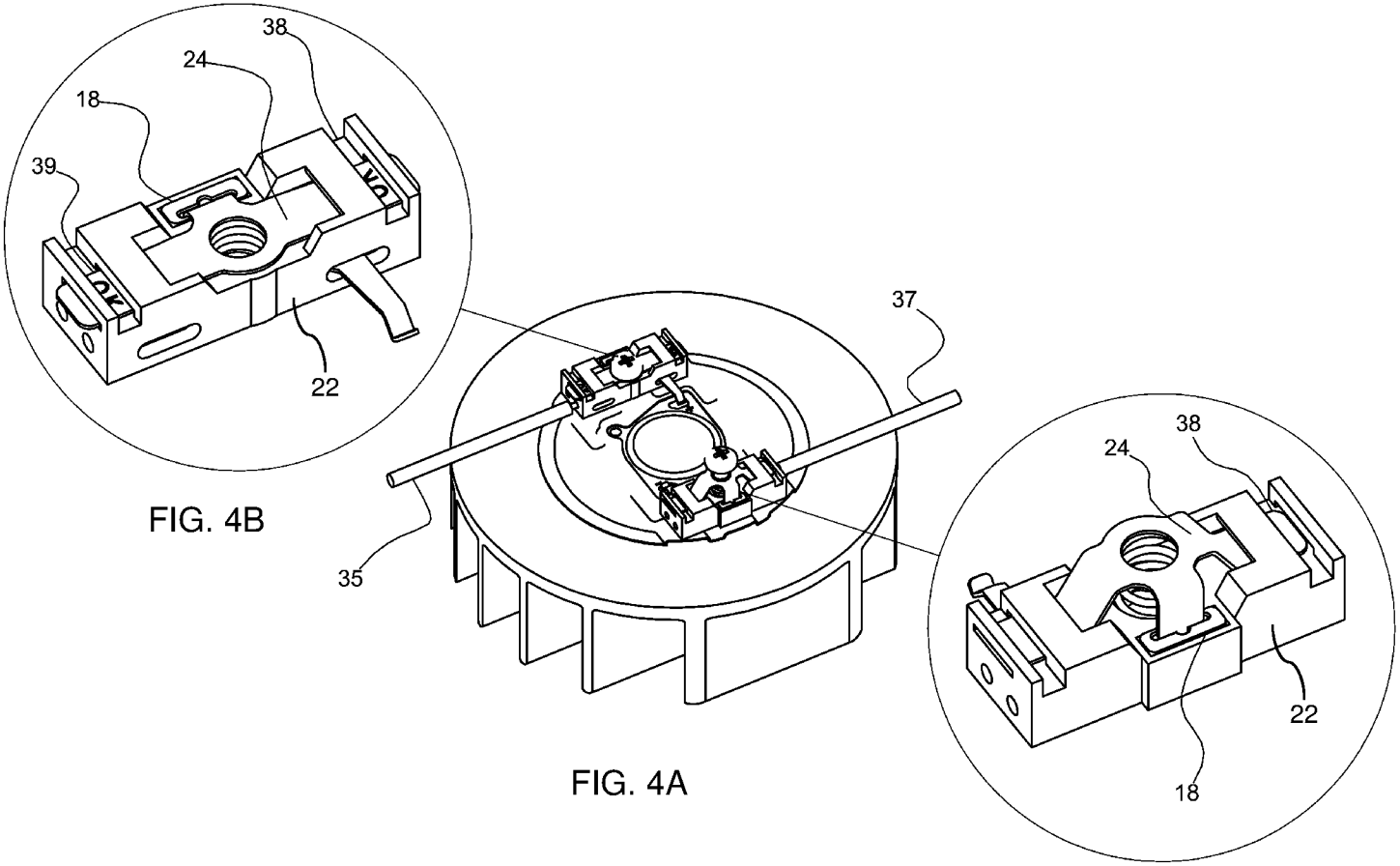
FIGS. 4A-4C shows various, perspective views of a compression activated switch device according to various embodiments. Specifically.

Turning to FIGS. 4A-4C, compression activated switch device 10 may include at least one aperture 38, which may be viewable through coupling component 22. In some embodiments, a mark 39 may be included on a portion of biasing element 24, which may be viewable through aperture 38 by virtue of the movement of mark 39 when biasing element 24 is compressed (see, FIG. 4B). These embodiments provide a visual indication of whether electrical switch 18 is in an electrically open or electrically closed position. Thus, one may view whether a proper and sufficient thermal connection has been made, as electrical switch 18 will only close in response to the predetermined amount of force being applied.

In other embodiments, an audible indication may be provided of sufficient force being applied to close electrical switch 18. For instance, a mechanical movement of electrical switch 18, such as switch element 34 closing, to the electrically closed position may provide an audible clicking or snapping noise indicating that a predetermined amount of force has been applied to coupling component 22, and thus the rest of compression activated switch device 10.

Figure 5:
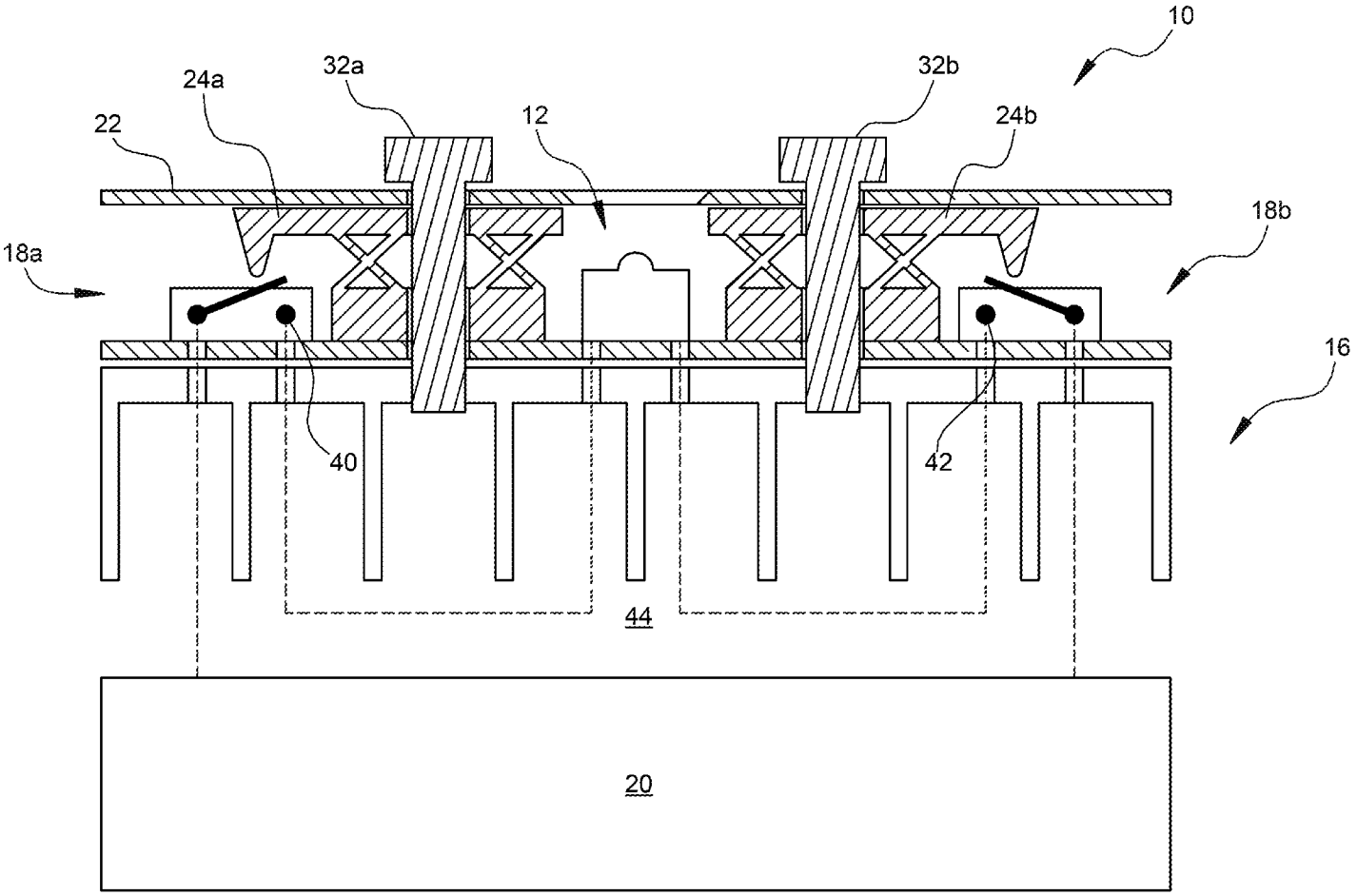
FIG. 5 shows a side partial cross-sectional view of a compression activated switch device according to various embodiments.

Turning to FIG. 5, in some embodiments, lighting systems similar to those described above, such as light emitting package 12, may have two contacts, electrodes 40 and 42, requiring two biasing elements 24*a* and 24*b*. For instance, compression activated switch device 10 may include, a first electrical switch 18*a* configured to operatively couple between a first contact 40 of a light emitting package 12, where light emitting package 12 includes a light emitting element 14 positioned on a support 16, and a power source 20. First electrical switch 18*a* is biased to an open position from a closed position. Compression activated switch device 10 can also include a coupling component 22 configured to couple light emitting package 12 to support 16.

In some embodiments, a first biasing element 24*a* may bias against coupling light emitting package 12 to a structure 44 with a first predetermined force, wherein in response to a force being applied to coupling component 22 sufficient to overcome the first predetermined force, first electric switch

18*a* moves to the closed position. Additionally, a second electrical switch 18*b* may be configured to operatively couple between a second contact 42 of light emitting package 12 and power source 20, and may be biased to an open position from a closed position.

In some embodiments, a second biasing element 24*b* may be included, also biasing against coupling light emitting package 12 to structure 44 with a second predetermined force, wherein in response to a force being applied to coupling component 22 sufficient to overcome the second predetermined force, second electrical switch 18*b* moves to the closed position. In these embodiments, coupling component 22 may be secured and force applied by fasteners 32*a* and 32*b*. For instance, a first fastener 32*a* may apply a first force to first biasing element 24*a* for closing first electrical force 18*a*, and a second fastener 32*b* may apply a second force to second biasing element 24*b* for closing second electrical switch 18*b*. The other elements of FIG. 5 are similar to the above defined elements of like numerals in FIGS. 1A-B, and may encompass any descriptions above. Additionally, any number of biasing elements 24 may be used, and should not be limited to one or two.

FIG. 5 is only illustrative of a setup for multiple biasing elements 24, as any number of biasing elements may be configured in compression activated switch device 10, in any format. For instance, in a roughly circular coupling component 22, between 2 and 10, including more or less, biasing elements 24 can be included in an approximately round configuration around coupling component 22, similar to those shown in FIGS. 3 and 4. Additionally, it should be understood that coupling component 22 can include any shape and can include any number of biasing elements 24 in any configuration in order to insure uniform compression and heat transfer.

Figure 6:
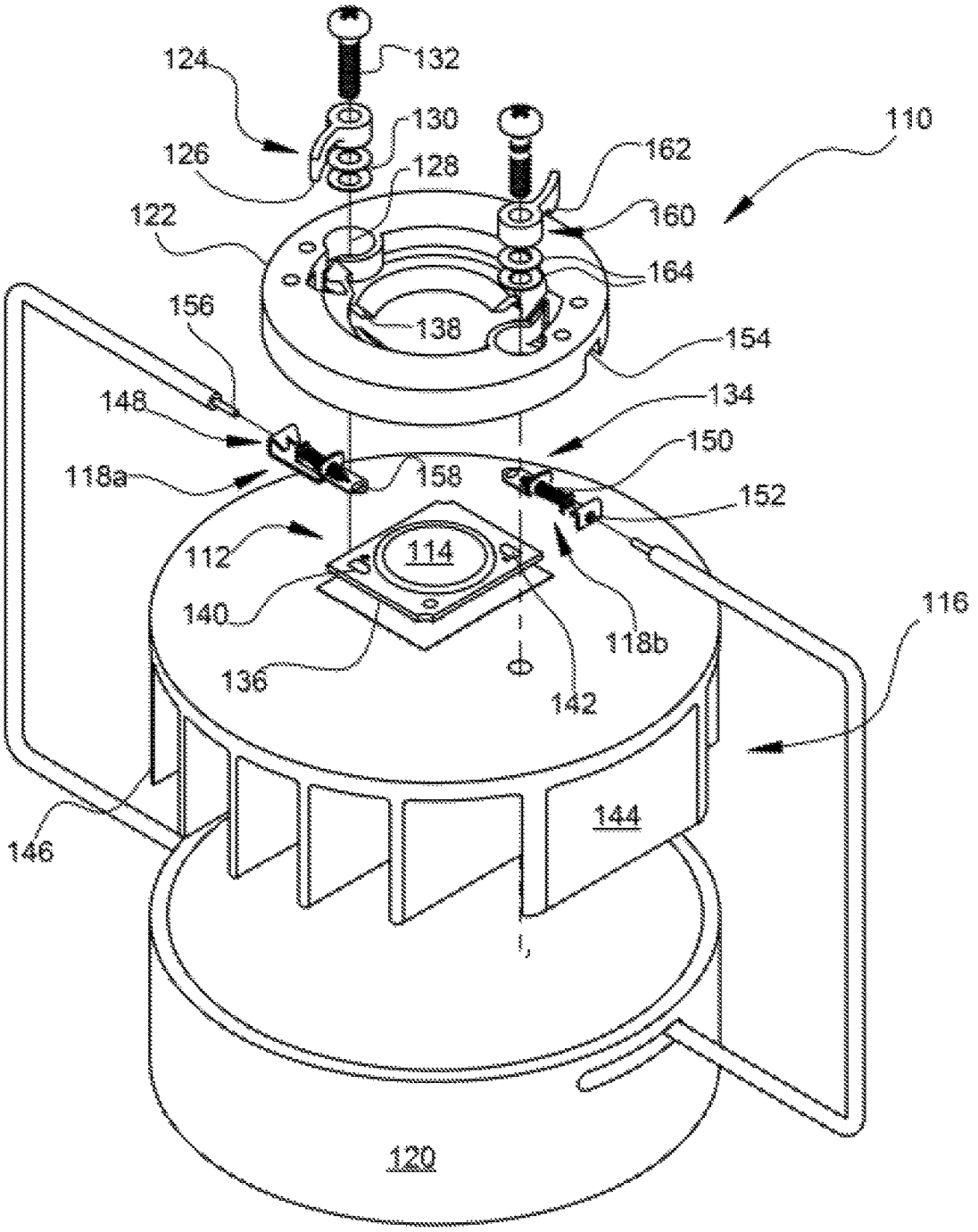
FIG. 6 shows an exploded perspective view of a compression activated switch device according to various embodiments.

Turning to FIG. 6, another example embodiment is shown. FIG. 6 illustrates an exploded perspective view of an embodiment of a compression activated switch device 110. In some embodiments, compression activated switch device 110 includes a coupling component 122 configured to couple a light emitting package 112 to a structure 144, for instance heatsink 146. Coupling component 122 can include any metal, plastic, or composite article, which may be formed or molded, for mounting light emitting package 112 to structure 144, such as may be used in mounting a ceiling or wall light fixture. As described herein, structure 144 can include heat sink 146 or other structure to which light emitting package 122 is attached. As also described herein, light emitting package 112 may include any light emitting package now known or later developed. Light emitting packages typically include at least one light emitting element 114, such as a light emitting diode (LED), which may be mounted on a circuit board 136 for powering light emitting package 112.

Compression activated switch device 110 may also include an electrical switch 118. Electrical switch 118 may be operatively positioned between light emitting package 112 and a power source 120 for powering light emitting package 112. Electrical switch 118 can include any electrical switch that remains in an electrically open position from an electrically closed position until a predetermined amount of force is applied between coupling component 122 and structure 144. In this embodiment, electrical switch 118 may include a micro switch 148, where micro switches can be small enough to fit within coupling component 122 or between coupling component 122 and light emitting package 112 without being visibly intrusive on assembled compression activated switch device 110. As noted, power source 120 may include any source of power, including A/C and D/C power sources, capable of providing enough power to light emitting package 112.

Still referring to FIG. 6, micro switch 148 may include an actuator 150, for biasing micro switch 148 open. As illustrated in FIG. 6, micro switch 148 may be structured to be press fit or secured with a fastener within a recess 154 of coupling component 122. Micro switch 148 may include a push in wire receptacle 152 for accepting a section of stripped solid core wire 156. Push in wire receptacle 152 may be accessible through recess 154 of coupling component 122 after all components of compression activated switch device 110 are secured to structure 144.

A contact 158 of micro switch 148 can be electrically coupled to power source 120 and physically coupled to wire receptacle 152. Contact 158 is biased to an electrically open position from an electrically closed position. For instance, bias may be provided by actuator 150 which can be coupled to wire receptacle 152. Actuator 150 is movable from a first position in which contact 158 is in the electrically open position, and under the predetermined amount of force, actuator 150 forces contact 158 of micro switch 148 into the electrically closed position. Actuator 150 may include a spring which can hold contact 158 in an open position, or a piece of metal with enough of a kink to provide a bias to an electrically open position.

Compression activated switch device 110 may also include a biasing element 124, which can include a switch press element 126 with a base element 128, for instance an adjustable plunger 160, for securing coupling component 122 to light emitting package 112. Adjustable plunger 160 should be at least partially in contact with a switch element 134, for instance a micro switch 148. Accordingly, adjustment of adjustable plunger 160 causes a portion of adjustable plunger 160 to apply force to micro switch 148. For instance, adjustable plunger 160 can include a plunger body 162 at least partially in contact with micro switch 148. Plunger body 162 may be partially curved and shaped such that force applied to plunger body 162 causes force to be applied to actuator 150 of micro switch 148. Thus, when a predetermined amount of force is applied to adjustable plunger 160, micro switch 148 moves to the electrically closed position, coming into contact with a first electrode 140. Biasing element 124 may also include a fastener 132, such as a threaded screw, for mechanically coupling plunger body 160 to structure 144.

In some embodiments, a biasing element 124 may include a compressible component 130, which may consist of at least one spring washer 164 between adjustable plunger 160 and coupling component 122. More than one spring washer 164 may be utilized, and the size, shape, thickness, and curvature of spring washer 164 may be designed or chosen in order to set the predetermined amount of force required to electrically close micro switch 148. For instance, a bent washer or cupped washer may be used, including Belleville washers.

In some embodiments, plunger body 162, and spring washer(s) 164 if used, are separate pieces which can be inserted into a recess in coupling component 122. However, in alternative embodiments, plunger body 162 and any necessary spring washer(s) 164 may be integrated into coupling component 122 using any locking mechanism, for instance a spring lock or plastic molded lock, requiring only fastener 132 to be included as separate pieces, although even fastener 132 may be sealed within coupling component 122. In such an embodiment, the predetermined amount of force can be adjusted at the manufacturing facility and installation may not require any adjustments by the installer, minimizing the level of skill necessary to install compression activated switch device 110. Additionally, coupling component may include at least one aperture 138 for visually observing if micro switch 148 is closed. In some embodiments, light emitting package 112 may include a first electrode 140 and at least a second electrode 142. According to some embodiments, electrical switch 118 may electrically contact first electrode 140, for instance via contact 158 of micro switch 148. Second electrode 142 may be electrically connected to power source 120.

In alternative embodiments, multiple electrical switches 118 may be utilized for contacting first electrode 140 and second electrode 142, as seen in FIG. 6. For instance, a first electrical switch 118 can be utilized for first electrode 140 and a second electrical switch 118B may be utilized for second electrode 142, with each electrical switch including any or all of the above described embodiments for pressing electrical switch.

According to the various embodiments described herein proper thermal connection can be achieved between light emitting package 12, 112 and heatsink 44, 144 and/or structure 16, 116. By providing an audible or visual indicator of the proper force being applied between these elements, a sufficient amount of compression can always be achieved to provide a thermal connection of sufficient amounts. Additionally, when electrical switch 18 (18*a* and 18*b*), 118 (118B) is not closed by biasing element 24 (24*a* and 24*b*), 124, power will not be provided when the thermal connection is not sufficient, thus decreasing the risk of damage to the light or the structure. If compression is lost over time, by loosening of parts or the like, power will again be cut according to certain embodiments, not allowing light emitting element 14, 114 to be powered when not achieving a good thermal connection.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

I claim:

1. A compression activated switch device, comprising:

a circuit board positioned on a structure;

a light emitting package including a light emitting element, the light emitting element positioned on the circuit board;

an electrical switch positioned on the circuit board, the electrical switch configured to be:

operatively coupled between the light emitting element of the light emitting package and a power source, and biased to an open position from a closed position;

a biasing element positioned on the circuit board, adjacent the electrical switch, the biasing element biasing against coupling the light emitting package to the structure with a predetermined force;

a coupling component positioned above and contacting the biasing element, the coupling component configured to couple the light emitting package to the structure; and a fastener extending through the circuit board, the biasing element, and the coupling component, the fastener applying a force to the coupling component to compresses the biasing element, wherein in response to the force applied by the fastener exceeds the predetermined amount of force, the electrical switch is moved into the closed position.

2. The compression activated switch device of claim 1, wherein the biasing element further comprises:

a switch press element operatively positioned to engage the electrical switch;

a base element for applying pressure to the light emitting package; and a compressible component operatively positioned between the switch press element and the base element, wherein the compressible component defines the predetermined amount of force.

3. The compression activated switch device of claim 2, wherein the predetermined amount of force required to compress the compressible component is adjustable.

4. The compression activated switch device of claim 2, wherein the compressible component comprises a spring washer.

5. The compression activated switch device of claim 2, wherein the force applied by the fastener compresses the compressible component of the biasing element.

6. The compression activated switch device of claim 2, wherein the electrical switch further comprises:

a first electrode electrically coupled to a power source;

a second electrode electrically coupled to the power source or the light emitting element; and a switch element coupled to one of the first electrode or the second electrode, the switch element biased to the open position from the closed position, wherein the switch press element of the biasing element applies force from the fastener to force the switch element of the electrical switch to the closed position.

7. The compression activated switch device of claim 1, wherein the predetermined amount of force is between approximately 5 pounds and approximately 50 pounds.

8. The compression activated switch device of claim 1, wherein the circuit board is operatively positioned between the structure and the biasing element.

9. The compression activated switch device of claim 1, wherein the structure includes a heatsink positioned below the circuit board.

10. The compression activated switch device of claim 1, wherein the biasing element and the electrical switch are integrated into the coupling component.

11. The compression activated switch device of claim 1, wherein the coupling component includes at least one aperture, and wherein a portion of the biasing element is viewable through the at least one aperture, and the portion of the biasing element includes a mark visually indicating the open position or the closed position of the electrical switch.

12. The compression activated switch device of claim 1, wherein a mechanical movement of the electrical switch to the closed position provides an audible indication in response to the predetermined amount of force being applied.

13. A compression activated switch device, comprising:

a support;

an electrical switch positioned on the support, the electrical switch biased to an open position from a closed position;

a biasing element positioned on the support, the biasing element including:

a switch press element operatively positioned to engage the electrical switch;

a base element positioned on the support, adjacent the electrical switch; and a compressible component positioned between the switch press element and the base element, the compressible component defining a predetermined amount of force;

a coupling component positioned on and contacting the biasing element;

a fastener extending through the coupling component, the biasing element, and the support, respectively, the fastener applying a force to the coupling component to compresses the compressible component of the biasing element, wherein in response to the force applied by the fastener exceeds the predetermined amount of force, the switch press element forces the electrical switch into the closed position.

14. The compression activated switch device of claim 13, further comprising:

a light emitting package operatively coupled to the electrical switch and a power source, the light emitting package including a light emitting element positioned on the support.

15. The compression activated switch device of claim 13, wherein the predetermined amount of force required to compress the compressible component is adjustable.

16. The compression activated switch device of claim 13, wherein the force applied by the fastener compresses the compressible component of the biasing element.

17. The compression activated switch device of claim 13, wherein the electrical switch further comprises:

a first electrode electrically coupled to a power source; and a second electrode electrically coupled to the power source or the light emitting element; and a switch element coupled to one of the first electrode or the second electrode, the switch element biased to the open position from the closed position, wherein the switch press element of the biasing element applies force from the fastener to force the switch element of the electrical switch to the closed position.

18. The compression activated switch device of claim 13, further comprising:

a structure, wherein the support is positioned on the structure.

19. The compression activated switch device of claim 18, wherein the structure includes a heatsink.

20. A compression activated switch device, comprising:

a support positioned on a structure;

a light emitting package positioned on the support;

an electrical switch positioned on the support, the electrical switch configured to be:

operatively coupled between the light emitting package and a power source, and biased to an open position from a closed position;

a biasing element positioned on the support, adjacent the electrical switch;

a coupling component positioned above and contacting the biasing element; and a fastener extending through the support, the biasing element, and the coupling component, the fastener applying a force to the coupling component to compresses the biasing element, wherein in response to the force applied by the fastener exceeds a predetermined amount of force, the electrical switch is moved into the closed position via the biasing element.

* * * * *